US012128994B1

(12) United States Patent
Shi

(10) Patent No.: US 12,128,994 B1
(45) Date of Patent: Oct. 29, 2024

(54) INFLATABLE FLOATING MAT

(71) Applicant: Dongguan Hongyu Plastic Co., Ltd., Guangdong (CN)

(72) Inventor: Juying Shi, Guangdong (CN)

(73) Assignee: Dongguan Hongyu Plastic Co., Ltd., Guangdong (CN)

( * ) Notice: Subject to any disclaimer, the term of this patent is extended or adjusted under 35 U.S.C. 154(b) by 0 days.

(21) Appl. No.: 18/425,345

(22) Filed: Jan. 29, 2024

(30) Foreign Application Priority Data

Dec. 6, 2023 (CN) ..... 202323329617.1

(51) Int. Cl.
*B63B 34/52* (2020.01)

(52) U.S. Cl.
CPC ..... *B63B 34/52* (2020.02)

(58) Field of Classification Search
CPC ..... B63B 34/00; B63B 34/50; B63B 34/52
USPC ..... 441/129
See application file for complete search history.

(56) References Cited

U.S. PATENT DOCUMENTS 5,186,667 A * 2/1993 Wang ..... B63B 34/52 441/130
5,437,068 A * 8/1995 Fisher ..... A47C 27/081 5/656
5,604,945 A * 2/1997 Fisher ..... A47C 27/081 5/710
6,645,026 B2 * 11/2003 Kuan ..... B63B 34/52 441/40
D571,429 S * 6/2008 Roberts ..... D21/803
10,550,594 B2 * 2/2020 Lection ..... B64D 1/22
2019/0269246 A1 * 9/2019 Youngblood ..... E04H 4/00

* cited by examiner

*Primary Examiner* — Daniel V Venne
(74) *Attorney, Agent, or Firm* — Cooper Legal Group, LLC

(57) ABSTRACT

An inflatable floating mat, includes a top sheet and a lower sheet superimposed one above another to form a body; a circumferential weld line, which is connected end to end along an edge of the body, to connect and seal the top sheet and the lower sheet, the top sheet, the lower sheet and the circumferential weld line enclose an inflatable cavity; a dividing weld line on the body, two ends of the dividing weld line are respectively connected at different positions of the circumferential weld line, the dividing weld line divides the inflatable cavity into a first sub-cavity and a second sub-cavity, and two inflating and deflating ports, a first one of the two inflating and deflating ports is in communication with the first sub-cavity, and a second one of the two inflating and deflating ports is in communication with the second sub-cavity.

7 Claims, 4 Drawing Sheets

A

B

INFLATABLE FLOATING MAT

CROSS-REFERENCE TO RELATED APPLICATION

This application claims the priority to Chinese patent application serial no. 202323329617.1, filed on Dec. 6, 2023. The entirety of Chinese patent application serial no. 202323329617.1 is hereby incorporated by reference herein and made a part of this specification.

TECHNICAL FIELD

The present application relates to a technical field of water inflatable products, and in particular, to an inflatable floating mat.

BACKGROUND ART

The inflatable floating mat is a product for people to enjoy in the water or on the beach, which is divided into two types: inflatable and non-inflatable. In short, it is actually a simple beach bed, which can be used for playing in the water, and can be used as a sofa bed on shore.

In the existing technology, the floating mat is a swim ring, which becomes a beach bed after inflating, and has the same size as a book after being deflated and folded when not in use, which is simple and convenient. However, the inflatable floating mat occupies a relative large space after being inflated, so it takes a long time to inflate, the user has to spend a lot of time waiting for inflation to be complete, this problem needs to be solved.

SUMMARY

In order to improve the inflation efficiency, thereby shortening the inflation time, the present application provides an inflatable floating mat.

The inflatable floating mat according to the present application adopts following solution.

An inflatable floating mat includes:

- a top sheet and a lower sheet, wherein the top sheet and the lower sheet are superimposed one above another, to form a body,
- a circumferential weld line, the circumferential weld line is connected end to end along an edge of the body, to connect and seal the top sheet and the lower sheet, the top sheet, the lower sheet and the circumferential weld line enclose an inflatable cavity,
- a dividing weld line, the dividing weld line is provided on the body, two ends of the dividing weld line are respectively connected at different positions of the circumferential weld line, the dividing weld line divides the inflatable cavity into a first sub-cavity and a second sub-cavity, and
- two inflating and deflating ports, a first one of the two inflating and deflating ports is in communication with the first sub-cavity, and a second one of the two inflating and deflating ports is in communication with the second sub-cavity.

By adopting the above solution, the top sheet and the lower sheet are superimposed one above another, to form the body, and are connected with each other and sealed to form the inflatable cavity by the circumferential weld line, the dividing weld line divides the inflatable cavity into the first sub-cavity and the second sub-cavity, two inflating and deflating ports are respectively provided on two sides of the dividing weld line, such that one inflating and deflating port is in communication with the first sub-cavity, so as to inflate and deflate the first sub-cavity, and at the same time, the other inflating and deflating port is in communication with the second sub-cavity, so as to inflate and deflate the second sub-cavity. The inflatable cavity can be inflated simultaneously through the two inflating and deflating ports, thereby improving the inflation efficiency of the inflatable floating mat, and thus shortening the inflation time.

Optionally, the body is provided with a plurality of shaping weld lines, the plurality of shaping weld lines are arranged at intervals in a first direction of the body, and each of the plurality of shaping weld lines extends in a second direction, the second direction includes an angle with the first direction of the body, and in an interval arrangement direction of the plurality of shaping weld lines, two adjacent ones of the plurality of shaping weld lines, the top sheet and the lower sheet enclose a shaping cavity.

By adopting the above solution, the shaping weld lines divide the inflatable cavity into a plurality of shaping cavities, which is conducive to improving the structure stability of the inflatable floating mat after being inflated, and is conducive to improving the buoyancy of the inflatable floating mat on the water, thereby improving the safety of the inflatable floating mat when in use.

Optionally, in an extension direction of each of the plurality of shaping weld lines, several shaping weld lines of the plurality of shaping weld lines are provided, and a clearance configured to connect two adjacent ones of the plurality of shaping cavities is defined between two adjacent ones of the several shaping weld lines in the extension direction of each of the plurality of shaping weld lines.

By adopting the above solution, when the inflatable floating mat is inflated through the inflating and deflating port, air can be delivered to each shaping cavity through the clearance, thereby realizing the inflation of the inflatable floating mat, which is conducive to improving the gas pressure uniformity of each shaping cavity.

Optionally, each of the plurality of shaping weld lines extends in waves in the second direction.

By adopting above solution, the structure stability and the aesthetic of the inflatable floating mat can be improved with this arrangement.

Optionally, each of the plurality of shaping weld lines comprises short lines and long lines, each of the long lines of one of the plurality of shaping weld lines is adjacent to a respective one of the short lines of the same one of the plurality of shaping weld lines at one end, and each of the long lines of the one of the plurality of shaping weld lines is adjacent to a respective one of the long lines of an adjacent one of the plurality of shaping weld lines at one side.

By adopting the above solution, the clearances can be evenly distributed on the body with this arrangement, which is conducive to improving the structure stability of the inflatable floating mat, and is conducive to preventing the edge of the inflatable floating mat from upwarp, thereby improving the safety of the inflatable floating mat.

Optionally, the body is provided with a plurality of rope retaining rings.

By adopting the above solution, a plurality of inflatable floating mats can be connected with each other by using the connection ropes through the rope retaining rings, which is conducive to enlarging the activity space of the inflatable floating mat when in use.

Optionally, each of the two inflating and deflating ports is provided with a sealing plug configured to seal a respective one of the two inflating and deflating ports.

By adopting the above solution, the sealing plug is used to seal the inflating and deflating port after the inflatable floating mat being inflated, thereby remaining the stability of gas pressure in the inflatable cavity.

Optionally, a connection strap is provided on a side of each of the two inflating and deflating ports, a first end of the connection strap is fixed on the body, and a second end of the connection strap is fixed on the sealing plug.

By adopting the above solution, the sealing plug is connected on the body via the connection strap, thereby preventing the loss of the sealing plug.

Optionally, a protective sheet configured to cover the two inflating and deflating ports is rotationally connected to the body.

By adopting the above solution, when the sealing plug is used to seal the inflating and deflating port, the protective sheet covers the two inflating and deflating ports, thereby preventing the user from opening the sealing plug by mistake when in use, which is conducive to improving the stability when in use.

Optionally, the circumferential weld line, the dividing weld line and the plurality of shaping weld lines are all configured as high-frequency heat-sealing lines.

By adopting the above solution, this arrangement is conducive to improving the firmness of the connection, which does not need much space, and saves material.

In summary, the present application has at least one of the following beneficial technical effectives.

1. The dividing weld line and two inflating and deflating ports are provided, such that the dividing weld line divides the inflatable cavity into the first sub-cavity and the second sub-cavity, two inflating and deflating ports are respectively provided on two sides of the dividing weld line, such that one inflating and deflating port is in communication with the first sub-cavity, so as to inflate and deflate the first sub-cavity, and at the same time, the other inflating and deflating port is in communication with the second sub-cavity, so as to inflate and deflate the second sub-cavity. The inflatable cavity can be inflated simultaneously through the two inflating and deflating ports, thereby improving the inflation efficiency of the inflatable floating mat, and thus shortening the inflation time.

2. The shaping weld lines are provided, such that the shaping weld lines divide the inflatable cavity into a plurality of shaping cavities, which is conducive to improving the structure stability of the inflatable floating mat after being inflated, and is conducive to improving the buoyancy of the inflatable floating mat on the water, thereby improving the safety of the inflatable floating mat when in use.

3. The protective sheet is provided, such that when the sealing plug is used to seal the inflating and deflating port, the protective sheet covers the two inflating and deflating ports, thereby preventing the user from opening the sealing plug by mistake when in use, which is conducive to improving the stability when in use.

DETAILED DESCRIPTION

The present application is further described in detail below in combination with FIGS. 1-4.

In order to supply enough activity space for users, and to improve the use experience, an inflatable floating mat generally occupies a large space after being inflated, which means that it takes a long time to inflate the inflatable floating mat, and the user has to spend a lot of time waiting for inflation to be completed before using the inflatable floating mat.

Figure 1:
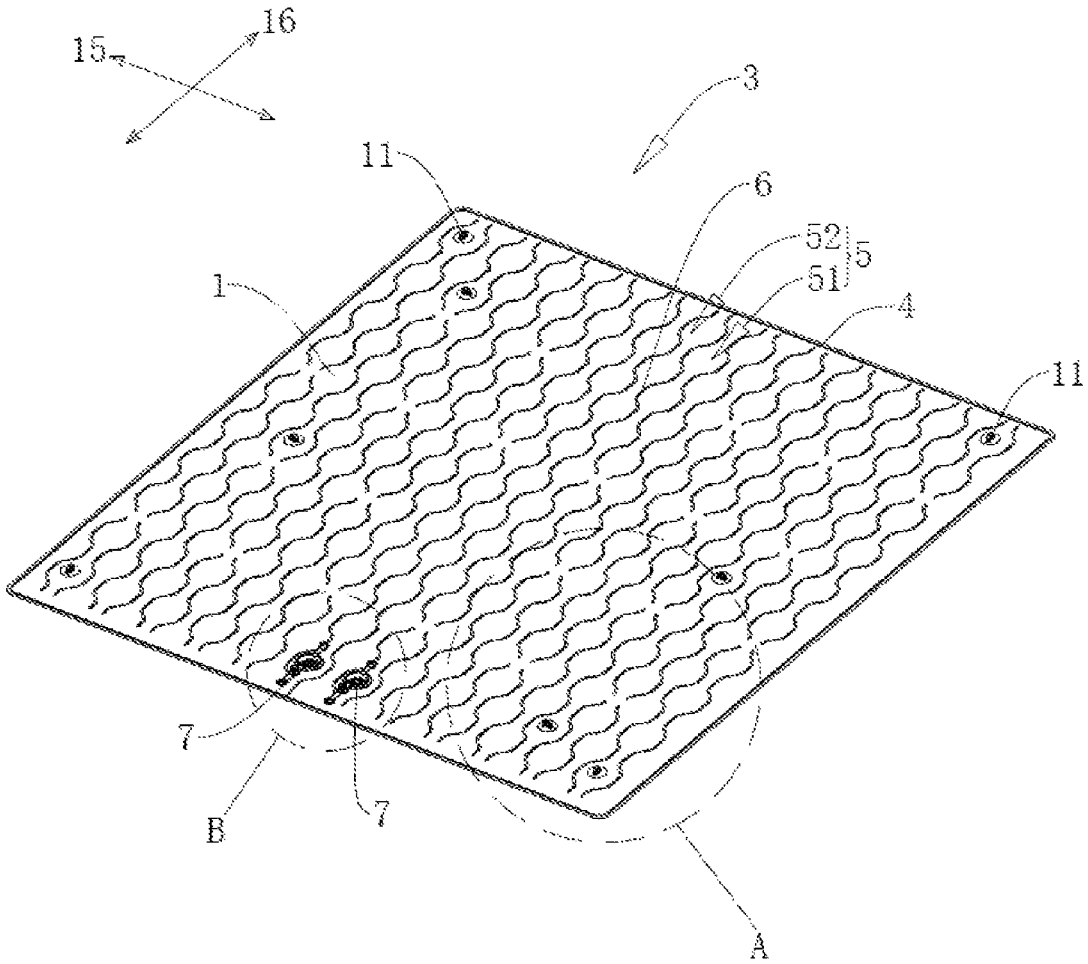
FIG. 1 is a schematic view of the inflatable floating mat according to the embodiment of the present application from the perspective of a top sheet.
Figure 2:
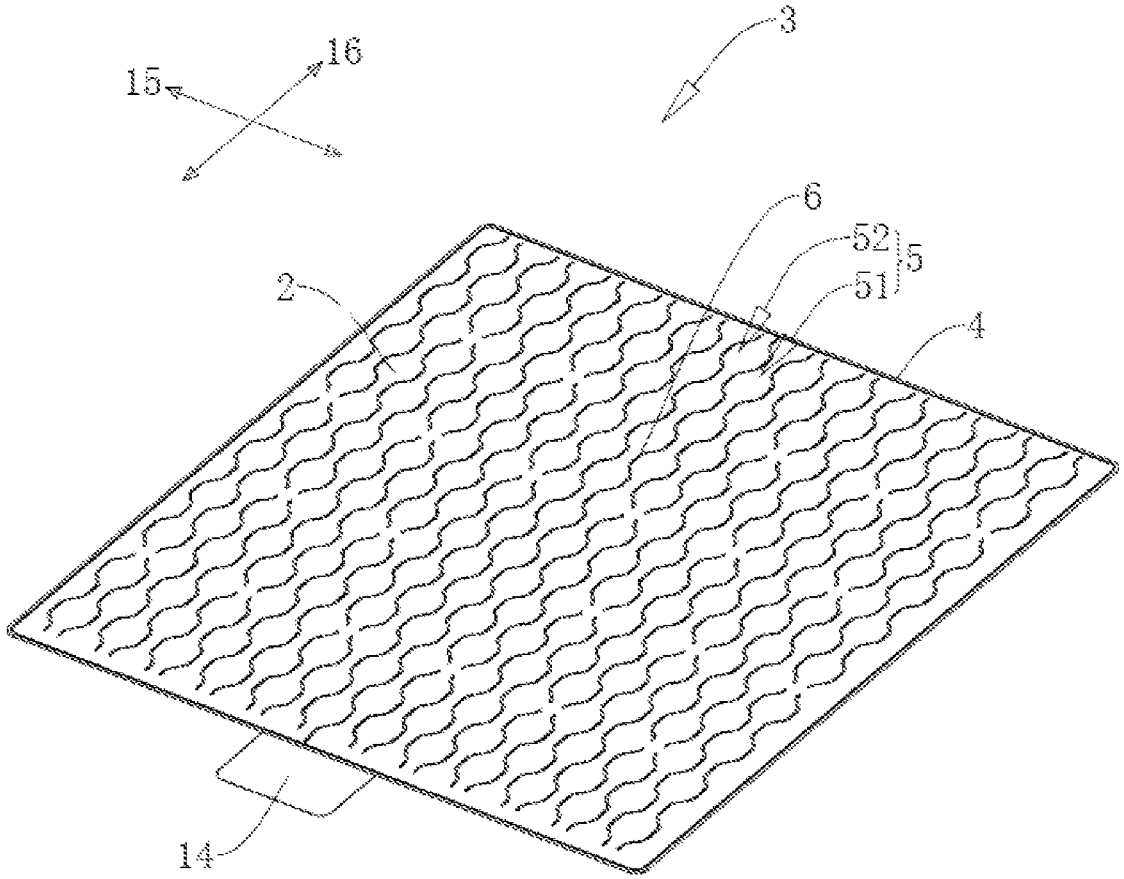
FIG. 2 is a schematic view of the inflatable floating mat according to the embodiment of the present application from the perspective of a lower sheet.

To overcome the above disadvantages, the embodiments of the present application disclose an inflatable floating mat, referring to FIGS. 1-2, which includes a top sheet 1 and a lower sheet 2, the two are same in shape. In the present embodiment, the top sheet 1 and the lower sheet 2 are rectangular, and are superimposed one above another, to form a body 3 of the inflatable floating mat.

Figure 3:
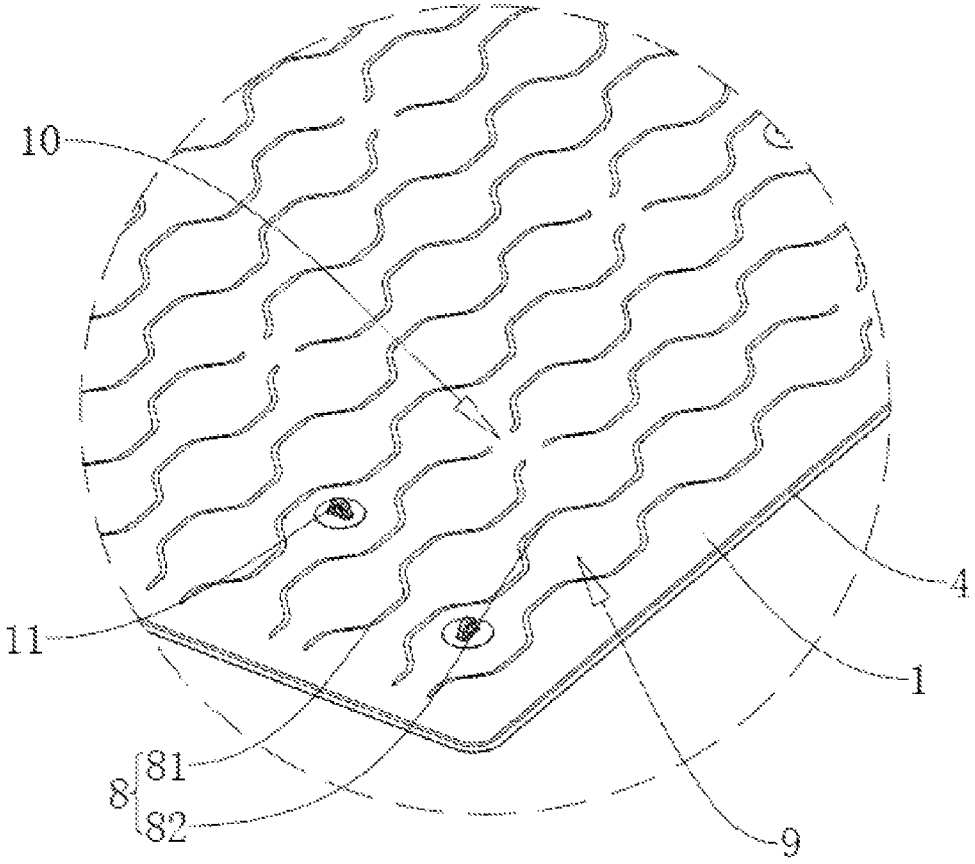
FIG. 3 is an enlarged view of A portion of FIG. 1.

Referring to FIGS. 2-3, the inflatable floating mat further includes a circumferential weld line 4, the circumferential weld line 4 is connected end to end along the edge of the body 3, to connect and seal the top sheet 1 and the lower sheet 2. The top sheet 1, the lower sheet 2 and the circumferential weld line 4 enclose an inflatable cavity 5. When the inflatable cavity 5 is inflated, the top sheet 1 and the lower sheet 2 is inflated for use. In the present application, the circumferential weld line 4 is configured as a high-frequency heat-sealing line, which means that the circumferential weld line 4 is configured to fixedly and tightly connect the top sheet 1 and the lower sheet 2 by high-frequency heat-sealing, by which the connection structure is omitted and the material is saved.

Figure 4:
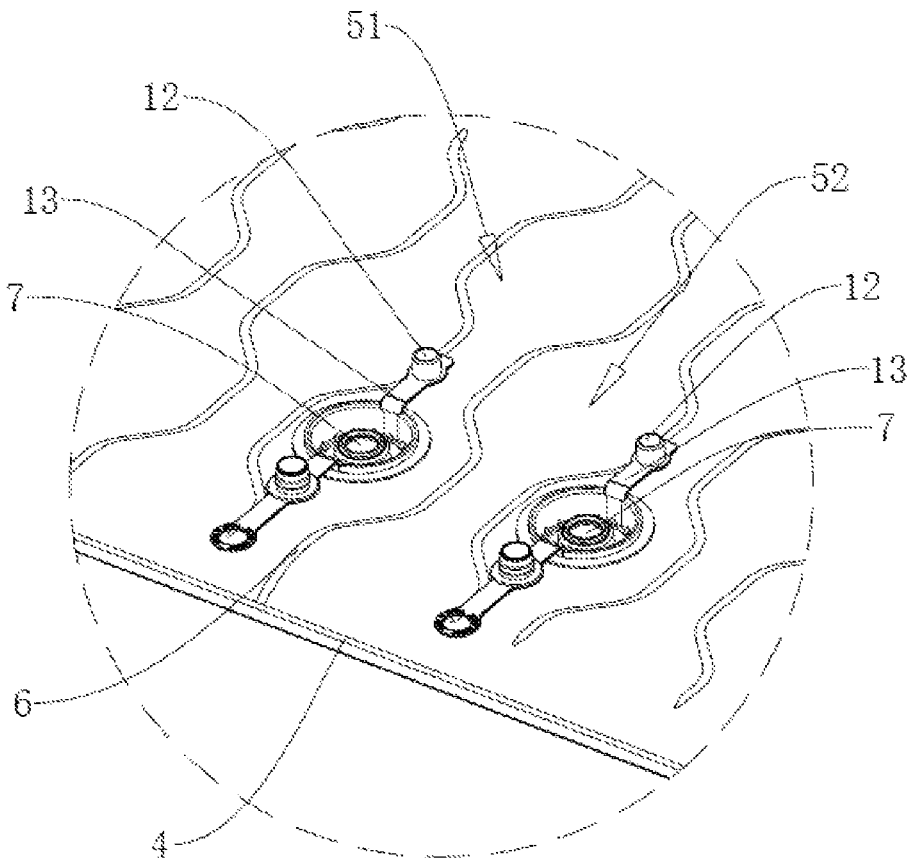
FIG. 4 is an enlarged view of B portion of FIG. 1.

Referring to FIG. 1 and FIG. 4, the inflatable floating mat further includes a dividing weld line 6, the dividing weld line 6 is provided on the body 3, two ends of the dividing weld line 6 are respectively connected at different positions of the circumferential weld line 4, such that the dividing weld line 6 divides the inflatable cavity 5 into a first sub-cavity 51 and a second sub-cavity 52. In the present embodiment, one end of the dividing weld line 6 is fixedly connected to a central position of one side of the circumferential weld line 4, the other end of the dividing weld line 6 is fixedly connected to a central position of the other side of the circumferential weld line 4 opposite to the one side, such that the dividing weld line 6 divides the inflatable cavity 5 into the first sub-cavity 51 and the second sub-cavity 52 with the same size. It should be understood that the dividing weld line 6 is also configured as a high-frequency heat-sealing line.

Referring to FIG. 1 and FIG. 4, the inflatable floating mat further includes two inflating and deflating ports 7, the two inflating and deflating ports 7 are symmetrically arranged on two sides of the dividing weld line 6, and the two inflating and deflating ports 7 are both located close to the edge of the body 3, which is convenient for users to use inflation equipment such as an inflation pump to carry out inflation and deflation. At the same time, one inflating and deflating port 7 is in communication with the first sub-cavity 51, the other inflating and deflating port 7 is in communication with the second sub-cavity 52, such that the first sub-cavity 51 and the second sub-cavity 52 can be simultaneously inflated through the two inflating and deflating ports 7, thereby improving the inflation efficiency.

It should be understood that a plurality of dividing weld lines 6 can be provided in other embodiments, the plurality of dividing weld lines 6 divides the inflatable cavity 5 into a plurality of sub-cavities, while the quantity of the inflating and deflating ports 7 can be determined based on the quantity of the sub-cavities, the two correspond to each other one by one, to further improve the inflation efficiency. Besides that, tone or more sub-cavities can be inflated as needed, so as to change the occupied area of the inflatable floating mat, which has strong applicability.

Referring to FIG. 1 and FIG. 4, the two inflating and deflating ports 7 are respectively detachably connected with a sealing plug 12 configured to seal the inflating and deflating port 7, the sealing plug 12 is tightly inserted in the inflating and deflating port 7, to prevent air leakage of the inflatable floating mat. At the same time, one side of each inflating and deflating port 7 is provided with a connection strap 13, one end of the connection strap 13 is fixed on the body 3, and the other end of the connection strap 13 is fixed on the sealing plug 12, such that the sealing plug 12 is connected to the body 3 to prevent from missing. In the present embodiment, the connection strap 13 and the sealing plug 12 are both made of soft silicone, to improve the flexibility of the connection strap 13 and the tightness of the sealing plug 12.

Referring to FIGS. 1-2, a protective sheet 14 configured to cover the two inflating and deflating ports 7 is rotationally connected to the edge of the body 3, the protective sheet 14 is configured as a rectangular sheet, one end of the protective sheet 14 connected to the body 3 is a connection end, while the other end of the protective sheet 14 is a free end. When it is necessary to cover the two inflating and deflating ports 7, the user can rotate the protective sheet 14 so that the protective sheet 14 covers the two inflating and deflating ports 7, and then fix the free end on the body 3. In the present embodiment, the free end is fixed on the body 3 via a Velcro, other detachable fixing way can also be used in other embodiments. The protective sheet 14 covers the two inflating and deflating ports 7 to prevent the user from opening the sealing plug 12 by mistake.

Referring to FIG. 1 and FIG. 3, the body 3 is provided with a plurality of shaping weld lines 8, the plurality of shaping weld lines 8 are arranged at interval along the first direction 15 of the body 3, and the plurality of shaping weld lines 8 extend along the second direction 16, which includes an angle with the first direction 15 of the body 3. It should be understood that the first direction 15 is the length direction of one side of the body 3, and the second direction 16 is the length direction of the other side of the body 3 adjacent to the one side. In the present embodiment, the first direction 15 is the length direction of the longer side of the body 3, and the second direction 16 is the length direction of the shorter side of the body 3. In the interval arrangement direction of the shaping weld line 8, two adjacent shaping weld lines 8, the top sheet 1 and the lower sheet 2 enclose a shaping cavity 9, to improve the structure stability of the inflatable floating mat after being inflated. Besides that, the shaping weld line 8 is also configured as a high-frequency heat-sealing line.

Referring to FIG. 1 and FIG. 3, in the extension direction of the shaping weld line 8, several shaping weld lines 8 are provided, there is a clearance 10 between two adjacent shaping weld lines 8 along the extension direction of the shaping weld line 8, the clearance 10 connects the adjacent shaping cavities 9, such that air can be delivered to each shaping cavity 9 through the clearance 10, to realize the inflation of the inflatable floating mat.

Referring to FIG. 1 and FIG. 3, the shaping weld line 8 extends in waves in the second direction 16, to improve the structure stability and the aesthetic of the inflatable floating mat. It is worth mentioning that the shaping weld line 8 includes a short line 81 and a long line 82, the short lines 81 and the long lines 82 are arranged in pairs at intervals in the arrangement direction of the shaping weld lines 8 at the edge of the body 3, such that the clearances 10 can be evenly distributed at the body 3, thereby further improving the structure stability of the inflatable floating mat. Specifically, "in pairs at intervals" means that a long line 82 of one shaping weld line 8 is adjacent to a short line 81 of the same one shaping weld line 8 at one end, and the long line 82 of the shaping weld line 8 is adjacent to a long line 82 of an adjacent shaping weld line 8 on one side. In particular, the length of the long line 82 is longer than the length of the short line 81.

Referring to FIG. 1 and FIG. 3, a plurality of rope retaining rings 11 are provided at intervals along the edge of the body 3, a plurality of bodies 3 can be connected to each other by using the connection rope through the rope retaining rings 11, thereby increasing the activity space when the user uses the inflatable floating mat. Besides that, the bodies 3 can be connected to other water products, such as a swim ring, a kayak, an inflatable bed, and an inflatable pillow and so on by using the connection ropes through the rope retaining rings 11.

The implement principle of the embodiment of the present application is as follows. When the user needs to use the inflatable floating mat, the first sub-cavity 51 and the second sub-cavity 52 are simultaneously inflated through the two inflating and deflating ports 7, which is beneficial to improve the inflation efficiency of the inflatable floating mat, and thus shortening the inflation time. When the user does not need to use the activity space of the whole body 3, only the first sub-cavity 51 or the second sub-cavity 52 is inflated through the respective one inflating and deflating port 7, which can reduce the activity space of the user on the inflatable floating mat. When the user needs to increase the activity space of the inflatable floating mat, he can use the connection ropes to connect a plurality of bodies with each other through the rope retaining rings 11, thereby increasing the activity space of the inflatable floating mat.

The above are the preferred embodiments of the present application, which are not intended to limit the protection scope of the present application. Therefore, all equivalent changes made according to the structure, shape and principle of the present application should be covered within the protection scope of the present application.

LIST OF REFERENCE SIGNS

1 top sheet
2 lower sheet
3 body
4 circumferential weld line
5 inflatable cavity
51 first sub-cavity
52 second sub-cavity
6 dividing weld line
7 inflating and deflating port
8 shaping weld line
81 short line
82 long line
9 shaping cavity
10 clearance
11 rope retaining ring

12 sealing plug
13 connection strap
14 protective sheet
15 first direction
16 second direction

What is claimed is:

1. An inflatable floating mat, comprising:

a top sheet and a lower sheet, wherein the top sheet and the lower sheet are superimposed one above another, to form a body, a circumferential weld line, wherein the circumferential weld line is connected end to end along an edge of the body to connect and seal the top sheet and the lower sheet, and the top sheet, the lower sheet and the circumferential weld line enclose an inflatable cavity, a dividing weld line, wherein the dividing weld line is provided on the body, two ends of the dividing weld line are respectively connected at different positions of the circumferential weld line, and the dividing weld line divides the inflatable cavity into a first sub-cavity and a second sub-cavity, and two inflating and deflating ports, wherein a first one of the two inflating and deflating ports is in communication with the first sub-cavity, and a second one of the two inflating and deflating ports is in communication with the second sub-cavity, wherein the body is provided with a plurality of shaping weld lines, the plurality of shaping weld lines are arranged at intervals in a first direction of the body, and each of the plurality of shaping weld lines extends in a second direction, the second direction includes an angle with the first direction of the body, and in an interval arrangement direction of the plurality of shaping weld lines, two adjacent ones of the plurality of shaping weld lines, the top sheet and the lower sheet enclose a shaping cavity, in an extension direction of each of the plurality of shaping weld lines, two or more shaping weld lines of the plurality of shaping weld lines are provided, and a clearance configured to connect two adjacent shaping cavities is defined between two adjacent ones of the two or more shaping weld lines in the extension direction of each of the plurality of shaping weld lines, each of the plurality of shaping weld lines comprises first lines and second lines, each of the second lines is longer than each of the first lines, each of the second lines of one of the plurality of shaping weld lines is adjacent to a respective one of the first lines of the one of the plurality of shaping weld lines at one end, and each of the second lines of the one of the plurality of shaping weld lines is adjacent to a respective one of the second lines of an adjacent one of the plurality of shaping weld lines at one side.

2. The inflatable floating mat according to claim 1, wherein each of the plurality of shaping weld lines extends in waves in the second direction.

3. The inflatable floating mat according to claim 1, wherein the body is provided with a plurality of rope retaining rings.

4. The inflatable floating mat according to claim 1, wherein each of the two inflating and deflating ports is provided with a sealing plug configured to seal a respective one of the two inflating and deflating ports.

5. The inflatable floating mat according to claim 4, wherein a connection strap is provided on a side of each of the two inflating and deflating ports, a first end of the connection strap is fixed on the body, and a second end of the connection strap is fixed on the sealing plug.

6. The inflatable floating mat according to claim 1, wherein a protective sheet configured to cover the two inflating and deflating ports is rotationally connected to the body.

7. The inflatable floating mat according to claim 1, wherein the circumferential weld line, the dividing weld line and the plurality of shaping weld lines are all configured as high-frequency heat-sealing lines.

* * * * *